US009558651B2

(12) United States Patent
Ramsdell et al.

(10) Patent No.: US 9,558,651 B2
(45) Date of Patent: Jan. 31, 2017

(54) CONVERTIBLE WIRELESS REMOTE CONTROLS

(75) Inventors: Blake Charles Ramsdell, Sammamish, WA (US); Robert Deming Dickinson, III, Woodinville, WA (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 764 days.

(21) Appl. No.: 12/944,837

(22) Filed: Nov. 12, 2010

(65) Prior Publication Data

US 2012/0119873 A1 May 17, 2012

(51) Int. Cl.
*G08C 17/00* (2006.01)

(52) U.S. Cl.
CPC ..... *G08C 17/00* (2013.01); *G08C 2201/30* (2013.01); *H01H 2219/039* (2013.01)

(58) Field of Classification Search
CPC ..... G08C 17/00; G08C 2201/30; H01H 2219/039
USPC ..... 340/4.11, 4.13, 4.3, 4.31, 4.34, 12.22, 340/12.24, 12.25, 12.27, 12.28, 12.29, 340/13.24; 345/163; 341/173, 176, 156; 455/575.1, 455/575.2, 575.3, 575.4
See application file for complete search history.

(56) References Cited

U.S. PATENT DOCUMENTS

| | | | | |
|---|---|---|---|---|
| 5,583,560 | A | 12/1996 | Florin et al. | |
| 6,240,555 | B1 | 5/2001 | Shoff et al. | |
| 6,327,459 | B2 | 12/2001 | Redford et al. | |
| 6,650,867 | B2 | 11/2003 | Redford et al. | |
| 7,123,242 | B1 * | 10/2006 | Henty | 345/169 |
| 7,421,376 | B1 | 9/2008 | Caruso et al. | |
| 7,516,074 | B2 | 4/2009 | Bilobrov | |
| 2005/0078087 | A1 * | 4/2005 | Gates et al. | 345/163 |
| 2007/0030251 | A1 | 2/2007 | Henty | |
| 2007/0142101 | A1 | 6/2007 | Seshagiri et al. | |
| 2007/0180461 | A1 | 8/2007 | Hilton | |
| 2008/0218397 | A1 | 9/2008 | Zylka et al. | |
| 2008/0239168 | A1 | 10/2008 | Henty | |
| 2008/0246890 | A1 | 10/2008 | Henty | |
| 2008/0311963 | A1 | 12/2008 | Strawn | |
| 2009/0002218 | A1 | 1/2009 | Rigazio et al. | |
| 2010/0127884 | A1 | 5/2010 | Sievert et al. | |
| 2010/0188249 | A1 | 7/2010 | Sievert et al. | |
| 2011/0128228 | A1 * | 6/2011 | Van der Byl | 345/167 |
| 2011/0151935 | A1 * | 6/2011 | Oksman et al. | 455/566 |

(Continued)

FOREIGN PATENT DOCUMENTS

| | | | |
|---|---|---|---|
| CN | 2705962 | A | 6/2005 |
| CN | 201075199 | Y | 6/2008 |

(Continued)

OTHER PUBLICATIONS

Website, 3 pages, available at http://en.wikipedia.org/wiki/Digital_video_fingerprinting, as of Jan. 21, 2011.

(Continued)

*Primary Examiner* — Nabil Syed
(74) *Attorney, Agent, or Firm* — Ference & Associates LLC

(57) ABSTRACT

Convertible wireless remote controls for controlling a variety of media devices are described. The convertible wireless remote controls function in a non-PC mode and a PC mode. The convertible wireless remote controls transition between modes offering control of a variety of devices in the different modes and are shaped with usability and power consumption in mind.

13 Claims, 8 Drawing Sheets

(56) References Cited

U.S. PATENT DOCUMENTS

2011/0248933 A1* 10/2011 Griffin et al. ..... 345/173

FOREIGN PATENT DOCUMENTS

| | | | |
|---|---|---|---|
| CN | 101432979 | A | 5/2009 |
| CN | 101510973 | A1 | 8/2009 |
| EP | 1023807 | A1 | 7/2002 |
| JP | 2004120248 | A | 4/2004 |

OTHER PUBLICATIONS

Website, 1 page, available at http://www.digitalsmiths.com, as of Feb. 4, 2011.

Alizada, Omeed, Examiner's Answer in U.S. Appl. No. 12/494,568 (Appeal No. 2013-006309), USPTO (Jan. 11, 2013) (7 pages).

Alizada, Omeed, Final Office Action in U.S. Appl. No. 12/494,568, USPTO (Jun. 20, 2012) (19 pages).

Alizada, Omeed, Office Action in U.S. Appl. No. 12/494,568, USPTO (Dec. 30, 2011) (19 pages).

Alizada, Omeed, Notice of Allowance in U.S. Appl. No. 12/751,933, USPTO (Dec. 5, 2013) (10 pages).

Alizada, Omeed, Final Office Action in U.S. Appl. No. 12/751,933, USPTO (Jul. 30, 2013) (22 pages).

Alizada, Omeed, Office Action in U.S. Appl. No. 12/751,933, USPTO (Mar. 14, 2013) (17 pages).

Sievert, Michael, Amendment in Response to Non-Final Office Action in U.S. Appl. No. 12/751,933 (Jun. 14, 2013) (12 pages).

Sievert, Michael, Amendment in Response to Final Office Action in U.S. Appl. No. 12/751,933 (Oct. 30, 2013) (15 pages).

Sievert, Michael, Amendment in Response to Non-Final Office Action in U.S. Appl. No. 12/494,568, (Mar. 30, 2012) (11 pages).

Sievert, Michael, Appeal Brief in U.S. Appl. No. 12/494,568 (Nov. 20, 2012) (20 pages).

* cited by examiner

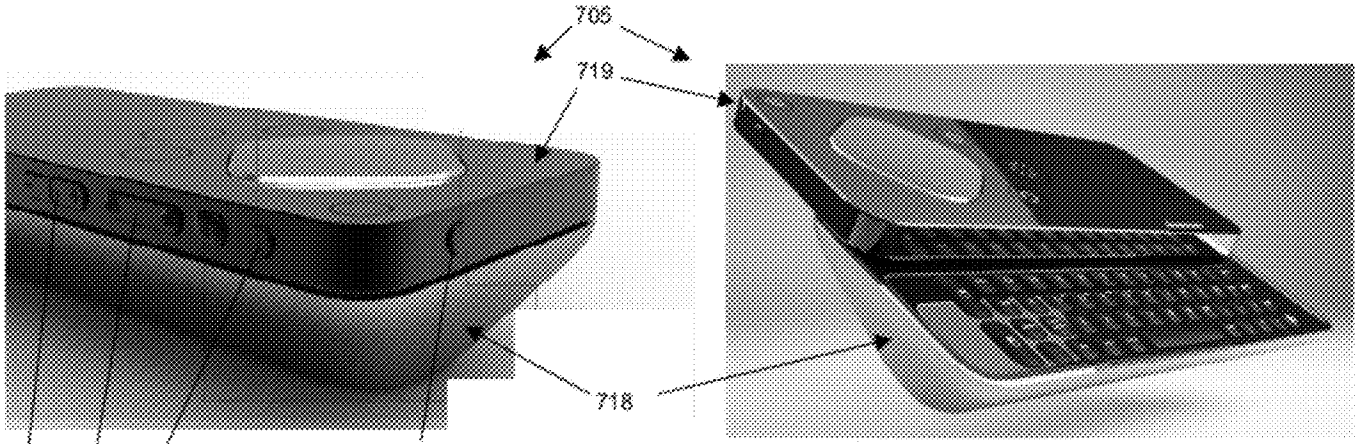
FIG. 7A
FIG. 7B
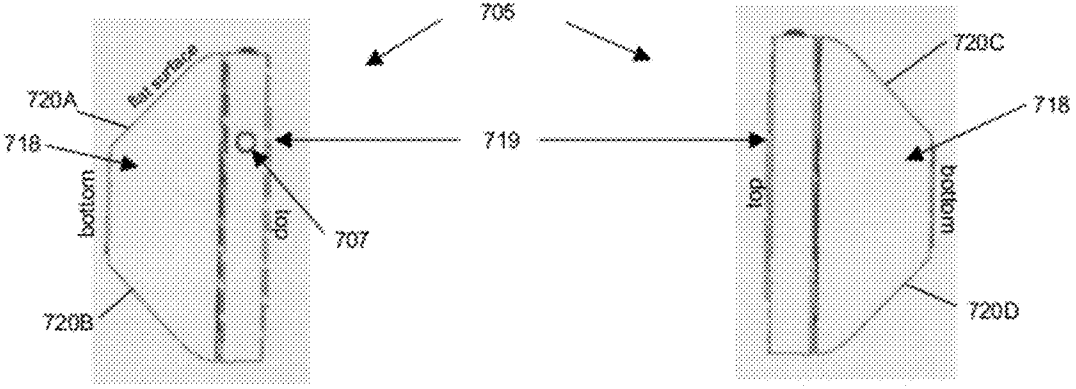
FIG. 7C
FIG. 7D

CONVERTIBLE WIRELESS REMOTE CONTROLS

BACKGROUND

A wide variety of remote controls are conventionally available for controlling a wide variety of devices including but not limited to media devices and players (e.g. Televisions, DVD players, VCRs, stereos, etc.), and media receivers (e.g. cable TV boxes, satellite TV receivers, etc.). These conventional remote controls often have a multitude of controls.

In addition, consumers are increasingly accessing Internet content to supplement more traditional media experiences. Common examples include using other devices including but not limited to laptop and desktop computers, cell phones, smart phones, etc. to obtain web pages while watching a television show.

BRIEF SUMMARY

In summary, one aspect provides a convertible wireless remote control comprising: an upper portion that is substantially flat; and a lower portion slidably connected to the upper portion; the lower portion having a substantially trapezoidal shape with substantially angular edges terminating in a bottom portion.

Another aspect provides a convertible wireless remote control comprising: an upper portion that is substantially flat; and a lower portion slidably connected to the upper portion; wherein the upper portion and the lower portion slide to transition between a PC control mode and a non-PC control mode.

A further aspect provides a convertible wireless remote control comprising: an upper portion that is substantially flat; and a lower portion slidably connected to the upper portion; the lower portion having a substantially trapezoidal shape with substantially angular edges terminating in a bottom portion; wherein the upper portion and the lower portion slide to transition between a PC control mode and a non-PC control mode.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings.

BRIEF DESCRIPTION OF THE SEVERAL VIEWS OF THE DRAWINGS

FIG. 7(A-D) illustrates views of an example convertible wireless remote control.

DETAILED DESCRIPTION

Figure 1:
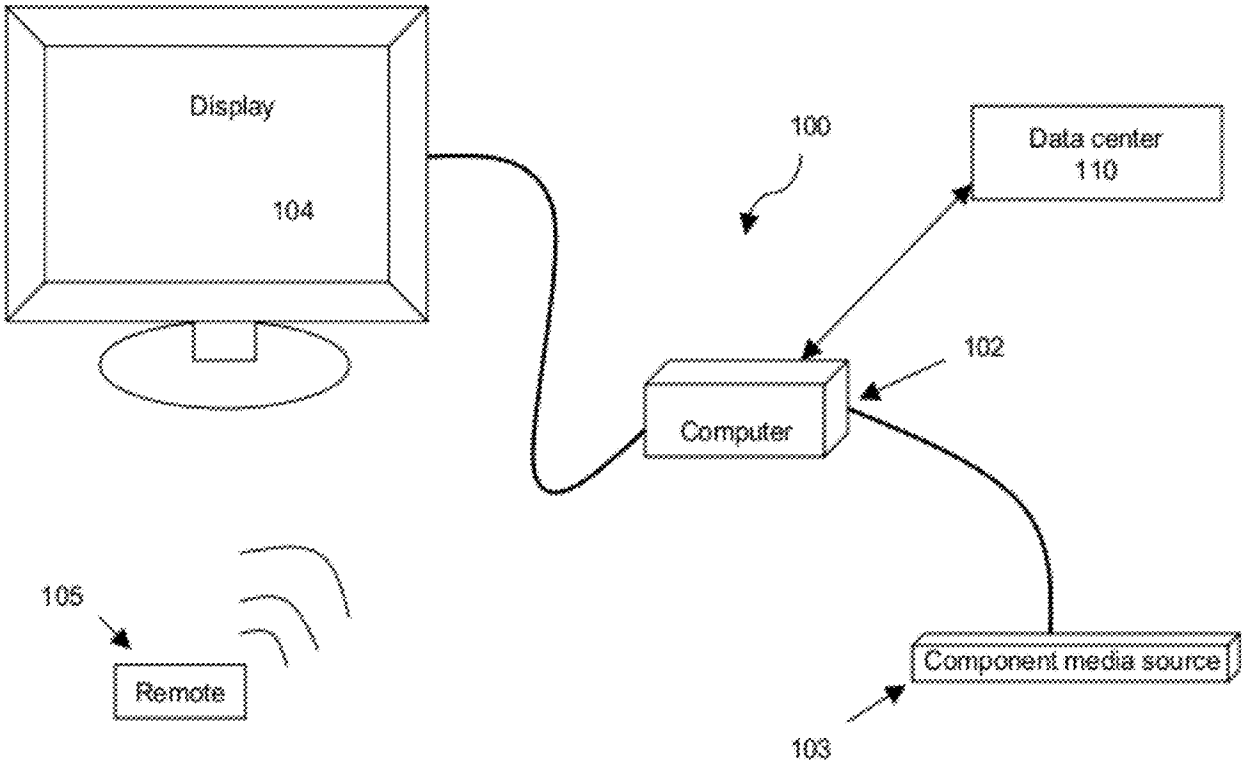
FIG. 1 illustrates an example of a multimedia management system.

It will be readily understood that the components of the embodiments, as generally described and illustrated in the figures herein, may be arranged and designed in a wide variety of different configurations in addition to the described embodiments. Thus, the following more detailed description of the example embodiments, as represented in the figures, is not intended to limit the scope of the claims, but is merely representative of those example embodiments.

Reference throughout this specification to "one embodiment" or "an embodiment" (or the like) means that a particular feature, structure, or characteristic described in connection with the example embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of example embodiments. One skilled in the relevant art will recognize, however, that aspects can be practiced without one or more of the specific details, or with other methods, components, materials, et cetera. In other instances, well-known structures, materials, or operations are not shown or described in detail to avoid obfuscation.

As above, utilization of various devices conventionally available in order to obtain a variety of desired media is less than ideal, as users must repeatedly switch between devices and applications. Some information on systems, devices and methods for providing an integrated media experience is found in co-pending and commonly owned U.S. patent application Ser. No. 12/415,638, filed on Mar. 31, 2009, entitled "SYSTEM AND METHOD FOR IDENTIFYING MEDIA AND PROVIDING ADDITIONAL MEDIA CONTENT", and in co-pending and commonly owned U.S. patent application Ser. No. 12/463,020, filed on May 8, 2009, entitled "SYSTEMS, METHODS AND APPARATUSES FOR MEDIA INTEGRATION AND DISPLAY", both of which are incorporated by reference here. Co-pending and commonly owned U.S. patent application Ser. No. 12/494,568, filed on Jun. 30, 2009, entitled "CONVERTIBLE WIRELESS REMOTE CONTROL", describes remote controls for media management systems, the contents of which are incorporated by reference.

Moreover, users have conventionally been forced to handle multiple remote control devices to utilize multiple media sources, e.g. to watch television, operate a DVD player, and/or surf the Internet. Accordingly, the inventors have recognized a need for an integrated system and remote control thereof that seamlessly combines the various capabilities of conventional devices, providing a truly integrated and easily controlled multimedia experience. Embodiments provide a convertible wireless remote control that allows for easy operation of a multimedia management system offering such an integrated media experience.

The embodiments described herein are generally directed to devices for remote control of a multimedia management system computer and associated devices in a variety of modes (PC and non-PC as used herein). Specifically, the embodiments provide users with a convertible wireless remote control which transitions between a PC mode and a non-PC mode. In a non-PC mode, the convertible wireless remote control is configured to control associated devices (for example, a television, a DVD player, a BLU-RAY DISC player, a stereo and the like) via a suitable communication means (for example, infrared (IR) signals). In a PC mode, the convertible wireless remote control is configured to control a PC of a media management system via a suitable communication means (for example, via radio frequency (RF) signals). BLU-RAY DISC is a registered trademark of the Blu-Ray Disc Association, Inc. in the United States and other countries.

The convertible wireless remote control converts between orientations, e.g. a portrait orientation and a landscape orientation. Each orientation is associated with a different mode by default. In each mode, the convertible wireless remote control can enable, disable or switch functionality of one or more input devices (buttons, touchpad, etc.). The mode of the convertible wireless remote control can be switched either through use of a switch (e.g. a mode button) or via a conformation change.

In addition, the embodiments have been designed to impart a shape useful in assisting users while handling the device and for providing added volume for inclusion of larger batteries. As described herein, a convertible wireless remote control provides a trapezoidal shaped lower portion that is slidably connected to an upper portion. The trapezoidal lower portion provides a flat surface for gripping with index fingers (as while typing in the landscape mode) and provides additional volume for larger batteries.

The description now turns to the figures. The example embodiments will be best understood by reference to the figures, and the scope of the invention will be pointed out in the appended claims.

Referring to FIG. 1, a feature of a multimedia management system 100 is to provide overlay of metadata on component media source 103 content, for example enabling enhanced interactive television (TV) experience in addition to existing TV content delivery. By way of useful contextual information, the multimedia management system 100 includes a computer 102, which can access component media (e.g. television HDMI feed) via a component media source 103 (e.g. cable box) and additional media (e.g. web pages) via a remote data center 110. The computer 102 includes suitable applications and/or hardware devices to provide integrated output for combined display on a display device 104 (e.g. HDTV).

Embodiments provide a convertible wireless remote control 105 as a primary control device for such a system 100, where the convertible wireless remote control 105 interacts with the media management system 100 via an appropriate means, such as RF (except for Power on/off functions), and additionally controls either the component media source 103 (e.g. STB) and/or the display 104 (e.g. TV) with, for example, IR.

Figures 2A, 2B:
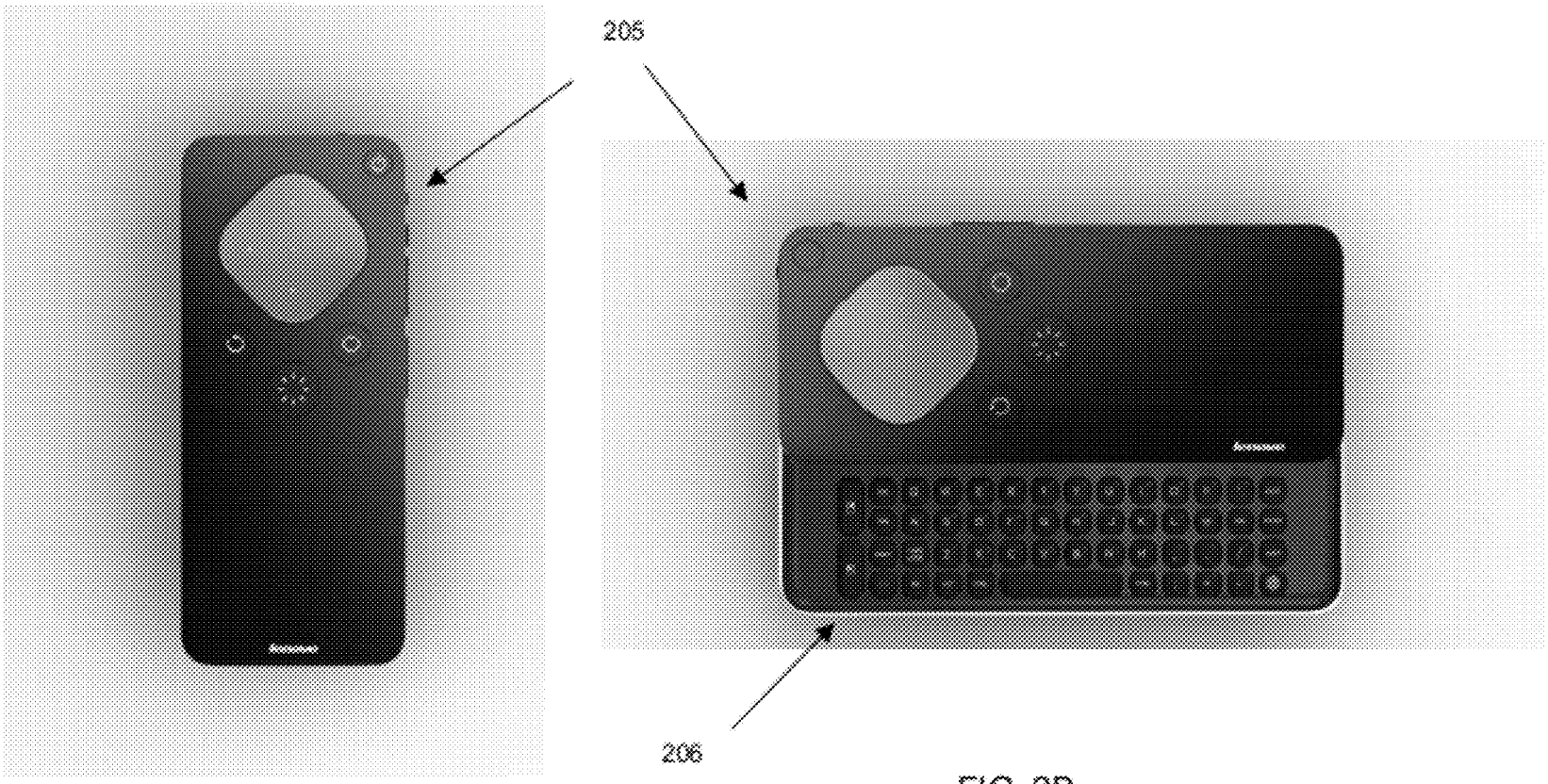
FIG. 2(A-B) illustrates an example convertible wireless remote control.

Referring to FIG. 2(A-B), in one embodiment, the convertible wireless remote control 205 operates in a portrait orientation (FIG. 2A) with a QWERTY keyboard (KB) closed (hidden) and in a landscape orientation (FIG. 2B) with the QWERTY KB 206 opened (exposed). The convertible wireless remote control 205 is convertible between the portrait and landscape orientations, for example using a slider mechanism, which can include a mechanical advantage (e.g. via use of a spring mechanism). Responsive to obtaining the different orientations, different functionality is enabled. Thus, in one embodiment, the convertible wireless remote control operates in a non-PC mode (for example, TV mode) in the portrait orientation and in a PC mode in the landscape orientation.

In one embodiment, the convertible wireless remote control 205 includes three main functions. First, the convertible wireless remote control 205 functions as a remote control using for example RF (2.4G) for computer (PC) control mode, and using for example IR for TV control mode. Also, the convertible wireless remote control 205 functions as an input device (e.g. touchpad input (mouse)) for PC control mode using for example RF (2.4G). Additionally, the convertible wireless remote control 205 functions as a second input device (for example, having a QWERTY Keyboard) for PC control mode using for example RF (2.4G).

In the PC control mode, corresponding to landscape orientation, a variety of options are possible for given scenarios. Essentially, the convertible wireless remote control 205 operates a suitable PC (for example, computer 102) as a standard remote control through, for example, RF (2.4G) with human interface device (HID) commands. For example, a Power Key function can be provided through LENOVO RC6 IR command if there is an IR receiver built into the PC. As another example, the Power Key function can be provided through RF (2.4G) with HID command, if there is RF Dongle plug in the USB Port of a PC (for example, LENOVO Q110 & Q700). As another example, for a device such as WINDOWS MEDIA CENTER® PC, the Power Key function can be provided through sending a MICROSOFT RF (2.4G) command. WINDOWS MEDIA CENTER is a registered trademark of Microsoft Corp. in the United States and other countries.

Figure 3:
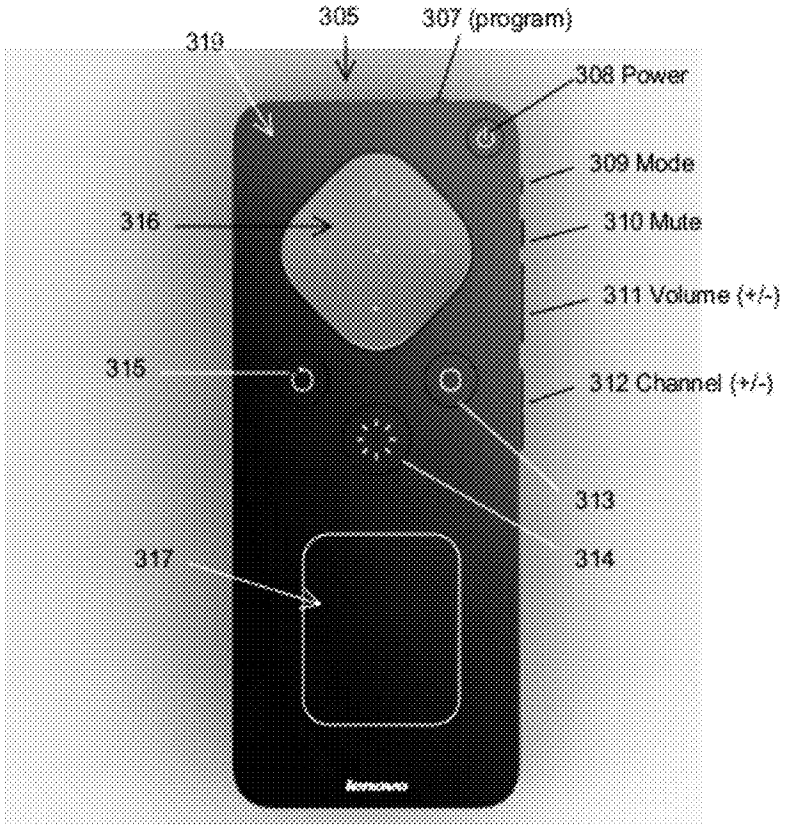
FIG. 3 illustrates a top view of an example convertible wireless remote control in portrait orientation.

Referring to FIG. 3, in one embodiment of the convertible wireless remote control 305, there are sixteen keys on a remote control layer 319 (portrait orientation). Fourteen of these keys are command sending keys. Two keys do not send a command, one key is provided for learn activation, and one key is provided for mode switching between non-PC mode (e.g. TV mode) and PC mode. The keys include a learn activation key 307 (and associated IR receiver), a power key 308, a mode key 309, a mute key 310, a volume rocker 311 (volume up and down keys), a channel rocker 312 (channel up and down), a settings key 313, a widget key 314, a back key 315, and a five way navigation control panel 316 (up, down, left, right and enter keys). Table 1 indicates some example functions for these keys.

The convertible wireless remote control 305 also includes a touchpad 317. When QWERTY is closed (portrait orientation), the touchpad 317 on the remote layer 319 is deactivated (default). The touchpad 317 can be activated/deactivated in the portrait orientation, for example by pressing the CH+ button of channel rocker 312 to activate and pressing CH− button of channel rocker 312 to deactivate. Thus, the user can control the PC even in portrait orientation. Likewise, in landscape orientation, the user can control other devices (e.g. a TV).

In one embodiment, LEDs are included as indicators. In an embodiment, LEDs are used in the portrait orientation and additional LEDs are used in the landscape orientation. The LEDs are used as back light indicators. For example, navigation control panel 316, back button 315, widget button 314, and setting button 313 back light LEDs are provided. For example, these keys (313-316) are provided with a blue back light for 3 seconds, followed by a time out, to indicate a function has been executed, enabled or disabled. Additionally, back light LEDs are included as indicators for modes, such as TV mode, and LEDs are included as indicators for power state. For example, the power button 308 back light turns on with a blue back light LED indicator for a predetermined time (e.g. 3 seconds), followed by a time out responsive to pressing the power button 308. Additionally, as an example, the TV back light activates for a predetermined time (e.g. 3 seconds) upon entry into TV mode, followed by a timeout.

TABLE 1

| Name | Standard HID Function (command mapping defined in SRS) |
|---|---|
| Back | Back (Browser back) |
| Round (Setting) | CTRL + ALT + S |
| Star (Widget) | CTRL + ALT + W |
| Up | Up |
| Down | Down |
| Left | Left |
| Right | Right |
| OK | OK |
| Volume Up | Volume Up |
| Volume Down | Volume Down |
| Mute | Mute |
| Channel Up | Activate touchpad while QWERTY close |
| Channel Down | Deactivate touchpad while QWERTY close |
| Power toggle | Version 1 = Lenovo RC6 IR code for Q200<br>Version 2 = WMC IR Power toggle code<br>Version 3 = RF(2.4G) HID Sleep toggle code |
| QWERTY open | CTRL + ALT + O |
| QWERTY close | CRTL + ALT + C |

** If any channel key is learned with IR, the other channel keys also become IR control.

As an example of non-PC mode, TV mode will be used herein as an example. In TV mode, the convertible wireless remote control 305 operates a TV as a standard remote control through IR. In one embodiment, as an example default, the convertible wireless remote control 305 does not come with any pre-programmed IR codes, which means all IR controls of the TV (model type) need to go through an IR learning process. In an embodiment, the convertible wireless remote control 405 can automatically learn IR codes (e.g. of STB and/or TV). For example, an end-user enters the TV mode (e.g. via press of the mode key 309) and then presses and holds the IR learn activation key 307. The end-user then presses a key for the target to be learned (e.g. TV). The original RC is then positioned proximate to the PC while pressing and holding the original RC key. Appropriate time outs are implemented. Key functions that can be learned with IR codes include for example: Back (Back/Exit Menu), TV Menu, TV Guide, Up, Down, Left, Right, OK, Volume Up, Volume Down, Mute, Channel/Page Up, Channel/Page Down, and Power toggle. These functions can be assigned to appropriate keys of the convertible wireless remote control 305 (see Table 3 for some non-limiting examples).

Figure 4:
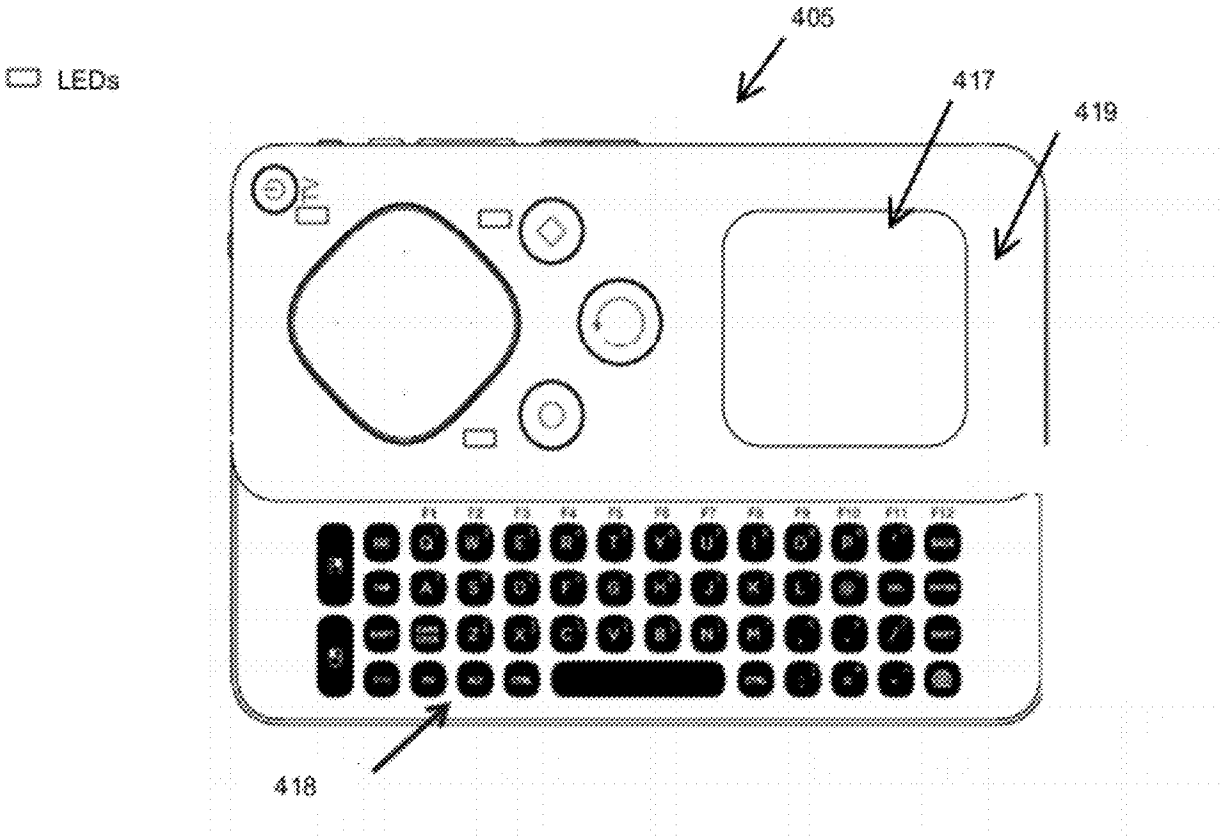
FIG. 4 illustrates a top view of an example convertible wireless remote control in landscape orientation.

Referring to FIG. 4, in one embodiment, in the landscape orientation, there are 51 keys on QWERTY KB layer 418. Two of these keys are for mouse left and mouse right key functions. As an example, the QWERTY KB layer 418 may be configured to only support PC mode functionality and work in RF (2.4G) rather than IR. Nonetheless, in landscape orientation (corresponding to PC control mode), some of the buttons (e.g. five way navigation panel 316) can switch from IR mode to RF mode, responsive to switching to PC mode (as for example by sliding to the landscape orientation or selecting the mode button 309).

In one embodiment, opening the QWERTY KB layer 418 (via a slider mechanism) will put the convertible wireless remote control 405 in PC mode. Closing the QWERTY KB layer 418 will return the convertible wireless remote control 405 to the opposite state (TV mode). Opening and closing of the QWERTY KB layer 418 slider will trigger the convertible wireless remote control 405 to communicate QWERTY open or close states, as appropriate, to PC 102. The convertible wireless remote control 405 includes a touchpad 417. When QWERTY KB layer 418 is opened, the touchpad 417 on the remote layer 419 is activated and the end-user can input commands to the PC 102.

In one embodiment, touchpad 417 mouse controls, when the touchpad 417 is activated, are supported as follows. A two dimensional mouse cursor control (corresponding to a cursor as in normal touchpad on a computer) are supported. For example, a single tap anywhere on the activated touchpad 417 area works as single mouse left click, whereas a double tap anywhere on the activated touchpad 417 area works as double mouse left click. A two point touch gesture sensing motion provides the corresponding response in display (zoom in or out), as per touchpad operation in a computer or mobile device (e.g. smart phone). In one embodiment, only two point coordinates will be sent, as the host will handle the application of two point touch gestures. In one embodiment, when the QWERTY KB layer 418 is opened or closed, the touchpad 417 will not wake up convertible wireless remote control 405 from SLEEP mode. Other example approaches for power management are described herein.

Proper power management for battery energy conservation is desirable to achieve an indicated battery life. Thus, in one embodiment, when the convertible wireless remote control 405 is idle a predetermined time (for about 3 seconds), the convertible wireless remote control 405 goes on STANDBY. After another predetermined time (for example, 3 minutes) of idling, the convertible wireless remote control 405 enters SLEEP mode. Upon a key press, the remote will wake up from SLEEP mode and go to the state it was in when it entered SLEEP mode (TV or PC mode).

Embodiments are designed with a lower portion (QWERTY KB layer 418) configured such that appropriately sized batteries are usable. In one embodiment, two AA Alkaline batteries power the convertible wireless remote control 405. These two AA batteries provide suitable powering of the convertible wireless remote control 405 given the particular dimensions of the convertible wireless remote control 405. Table 2 lists some example power state characteristics of the convertible wireless remote control 405. Different use levels will naturally affect the battery life. However, a useful battery life for operating the computer and/or television for viewing web pages and/or television movies is estimated at 100 days for the batteries indicated and the usage described herein.

TABLE 2

| Power state | Remote Control state | RF state | Touchpad state |
|---|---|---|---|
| ACTIVE, instantaneous response | Back light on Active | QWERTY Back light on Active | Active |

TABLE 2-continued

| Power state | Remote Control state | RF state | Touchpad state |
|---|---|---|---|
| STANDBY, near instantaneous response | Sleep | Sleep | Doze |
| SLEEP, near instantaneous response | Back light off Sleep | Sleep | Sleep |

In one embodiment, a stuck key time out function is implemented. Stuck key means a button has been pressed for a predetermined amount (long time) in normal operating mode. To preserve battery power, the convertible wireless remote control 405 will stop sending commands and shut down at a predetermined time (for example, about 30 seconds) after the last key transition to consume minimal power. Afterwards, the convertible wireless remote control 405 can be powered up again, all keys are released, and the convertible wireless remote control 405 resumes normal operation.

In one embodiment, a remote idling RF link time-out is provided. When no key press has been detected, and no touchpad activities (during QWERTY KB open) are detected, for a predetermined time, the convertible wireless remote control 405 control will enter STANDBY mode. During STANDBY mode, RF link will be disconnected to preserve power. Touching the touchpad 417 (during QWERTY KB open) or pressing any key will resume the convertible wireless remote control 405 to ACTIVE mode almost immediately (<1 second). Key presses that resume convertible wireless remote control 405 from STANDBY mode can be remembered and transmitted. When the convertible wireless remote control 405 wakes up from SLEEP, there may be re-connection latency up to 1 second depending on the RF link condition (for example with certain computer types). Once the RF (2.4G) link has been established, the convertible wireless remote control 405 will execute upon any key press. Key presses prior to RF link successful connection will not be transmitted.

In one embodiment, a RF broken link function is provided. For example, when the RF (2.4G) connection is lost (for example, when the computer enters sleep mode or during system shutdown (S3, S4 or S5 states) or due to out of range), the convertible wireless remote control 405 will enter SLEEP mode.

For handling low battery power levels and indication thereof, an embodiment operates as follows. When the convertible wireless remote control 405 is in ACTIVE mode, and if the battery voltage level is at a (predetermined) low level, and after each key press is released, the power button 308 will flash twice quickly 3 times (via a back light LED) to indicate battery low. All functions remain usable with a low battery, but preferably the following tasks will be disabled in favor of power savings: IR learn, RF pairing and soft reset. The convertible wireless remote control 405 will continue to function for a predetermined time, for example about another 10 minutes (based on highest consumption, that is RF active, touchpad operating, back light(s) on, etc.).

Table 3 includes some examples of key functions in PC mode and TV mode.

TABLE 3

| | PC mode | TV mode |
|---|---|---|
| Indication | "TV" symbol not lit<br>All lid buttons back lit blue | "TV" symbol back lit white<br>All lid buttons back lit off |
| Power key | Version 1 = IR On/Off code for appropriate computer<br>Version 2 = RF (2.4G) HID Sleep toggle code | Programmable (IR communication)<br>Generally turns TV on/off |
| 5-Way navigation keys | Sends PC HID up/down/left/right arrow keys for directional buttons.<br>Center key press sends<br>PC the Enter button (RF communication) | Programmable (IR communication)<br>Generally navigates TV menu/guide |
| Back key | Sends the PC Back key (RF communication) | Programmable (IR communication)<br>Generally activates Back/Exit TV menu |
| (Widget) soft key | Key code (RF communication)<br>Intended to activate Widget | Programmable (IR communication)<br>Generally activates TV guide |
| (Settings) soft key | Key code (RF communication)<br>Intended to activate Settings | Programmable (IR communication)<br>Generally activates TV menu |
| Learn side key | Not active in this mode<br>When QWERTY open, activate RF pairing | Press & hold 3 seconds to activate IR learn mode.<br>While in IR learn mode, press again to exit learn<br>When no key selection in learn mode for 30 sec, exit learn<br>When no incoming IR signal for 10 sec after selected key, select key time out |
| Mode side key | Changes to TV mode | Changes to PC mode |
| Mute side key | Volume control in 2.4 GHz RF | Default setting controls host PC Mute by RF.<br>If any volume or mute key is programmed to an IR code, all volume and mute keys must communicate by IR. |
| Volume +/− side keys | Volume control in 2.4 GHz RF | Default setting controls host PC Volume by RF.<br>If any volume or mute key is programmed to an IR code, all volume and mute keys must communicate by IR. |

TABLE 3-continued

| | PC mode | TV mode |
|---|---|---|
| Channel +/− side keys | No code<br>Ch + touch pad on while QWERTY close<br>Ch − touch pad off while QWERTY close | Default setting controls host PC Channel by RF.<br>If any channel key is programmed to an IR code, the other channel key must also communicate by IR. |
| Open QWERTY | Stays in PC mode.<br>Communicates QWERTY state to host PC.<br>Touchpad activated.<br>Power button light turns off. | Changes to PC mode.<br>(refer to Open QWERTY in PC mode) |
| Close QWERTY | Stays in PC mode.<br>Communicate state to host PC.<br>Deactivates touch pad.<br>Ch + touch pad on while QWERTY close<br>Ch − touch pad off while QWERTY close<br>Power button light turns on. | Changes to TV mode.<br>Communicates QWERTY state to host PC.<br>Deactivates touch pad. |

For embodiments using 2.4 GHz RF, RF link support for the convertible wireless remote control 405 mouse and KB are for example as follows. On the computer side, RF link interface to the system is accomplished via USB. The remote and computer can be paired as a default. The following standard USB HID profiles can be used:

| Remote Control | Consumer control HOD profile |
|---|---|
| Touchpad Mouse: | Mouse HID profile |
| QWERTY KB: | Keyboard HID profile |

RF pairing takes place, for example, according to a proximity pairing method, when both the convertible wireless remote control 405 and computer 102 are in RF pairing mode and they are within a short distance (for example, 6 cm apart) from each other. For example, the end-user slides the remote layer and the bottom QWERTY layer 418 apart via a slider mechanism and activates a RF pairing application on the system (PC). The end-user presses and holds the RF learn option within the application for a predetermined time (e.g. three seconds) while the remote is in proximity to (e.g. 6 cm) the system (PC). Pairing will complete successfully or, one or more auto retries can execute until a time out (e.g. 180 seconds). In one embodiment, the wireless remote control 405 enters a sleep mode after a predetermined period of inactivity (e.g. three seconds) or when the RF link is broken, and automatically resumes after a key press or other input (e.g. via touchpad) or the RF link is reestablished (e.g. via bringing the devices into proximity). Once RF pairing has been accomplished, there is no further RF repairing required (RF link automatically reconnects).

In an embodiment, a RF auto pairing "Zero Touch" function is supported. For example, if RF is not paired as a factory default or after a master reset, when the end-user loads the batteries for the first time under these conditions, the convertible wireless remote control 405 will enter RF pairing state automatically (for example, within 3 seconds). The convertible wireless remote control 405 shows a RF Pairing indication (e.g. LED back light). The user brings the convertible wireless remote control 405 near to the computer for proximity pairing to take place. After successful pairing, the convertible wireless remote control 405 will not go into "Zero Touch" function even when the end user re-loads the batteries.

In one embodiment, a soft reset (erasure of for example RF pairing information, RC learn information, and other setting information) can be accomplished. For example, an end-user closes QWERTY KB layer 418, removes the batteries, presses and holds the power and mode buttons, and reinserts the batteries. This will clear saved programming information.

Figures 5A, 5B:
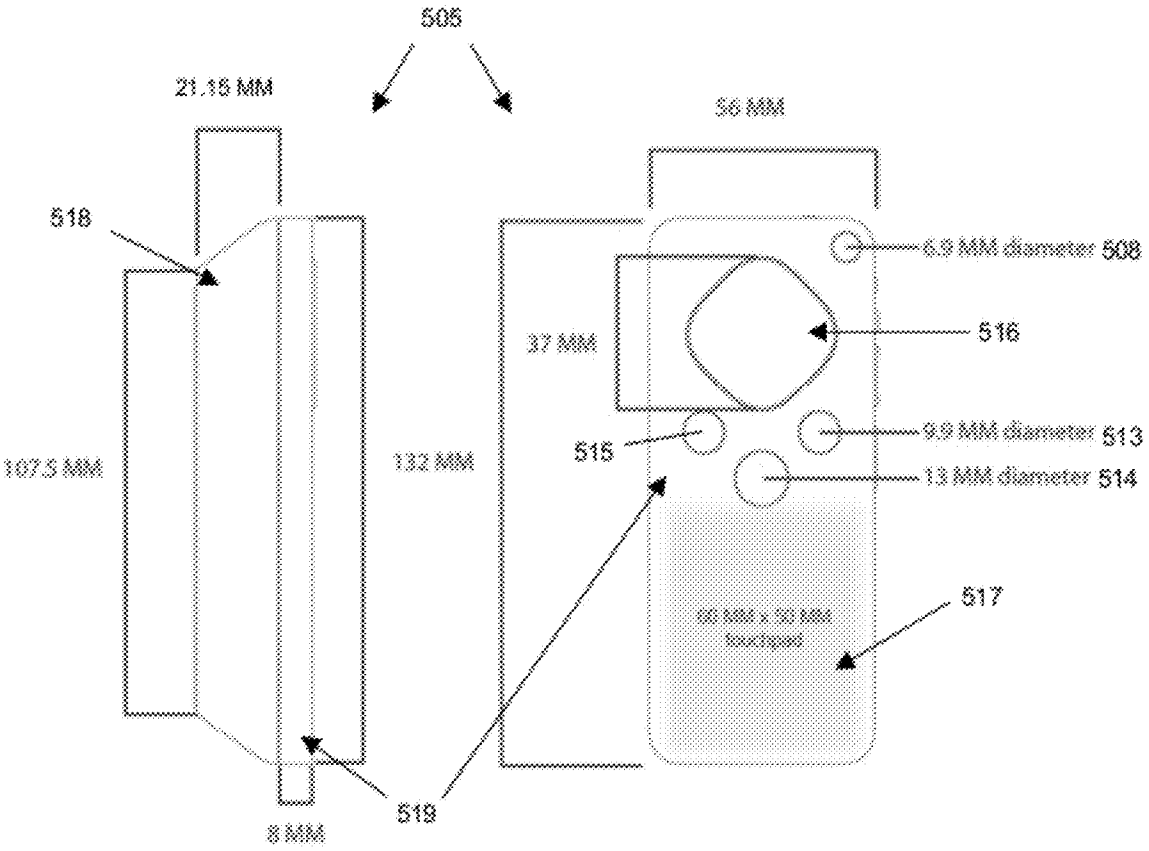
FIG. 5A illustrates a side view of an example convertible wireless remote control.
FIG. 5B illustrates a top view of an example convertible wireless remote control in portrait orientation.

Referring to FIG. 5(A-B), some example dimensions for a convertible wireless remote control 505 in the portrait orientation are illustrated. Referring to FIG. 5(A), a side view of the convertible wireless remote control 505 is illustrated. The top remote layer 519 is about 8 mm thick, with a top surface of about 132 mm. The lower QWERTY KB layer 518 is preferably trapezoid shaped, offering a comfortable feel allowing the end-user to securely grip the convertible wireless remote control 505 and offering enough space for two AA batteries (and other components). The lower QWERTY KB layer 518 has for example a thickness of about 21.15 mm (including battery cover, styling groove and gap between top and bottom slide layers) and a bottom length of about 107.5 mm. The lower QWERTY KB layer 518 has for example a top length of about 132 mm.

Referring to FIG. 5(B), top remote layer 519 has a width of about 56 mm. The top remote layer 519 includes a five way navigation control panel 516 (up, down, left, right and enter keys) using for example a five way switch matching the feel and performance of SENSONAV® switch (Part number ET-PS-Nav.-210). The five way navigation control panel 516 is for example about 37 mm in length, having a diamond shape, as illustrated. SENSONAV is a registered trademark of Coactive Technologies, Inc. in the United States and other countries.

Remote layer 519 top surface includes a power button 508, for example in an upper right corner having a diameter of about 6.9 mm. The remote layer 519 top surface further includes a settings key 513 and a back key 515, each having a diameter of about 9.9 mm. The remote layer 519 further includes a widget key 514 having a diameter of about 13 mm. The touchpad surface 517 is also included in the remote layer 519, having for example an area of 60 mm×50 mm. The overall weight of the convertible wireless remote control 505 is about 170 g.

Figure 6:
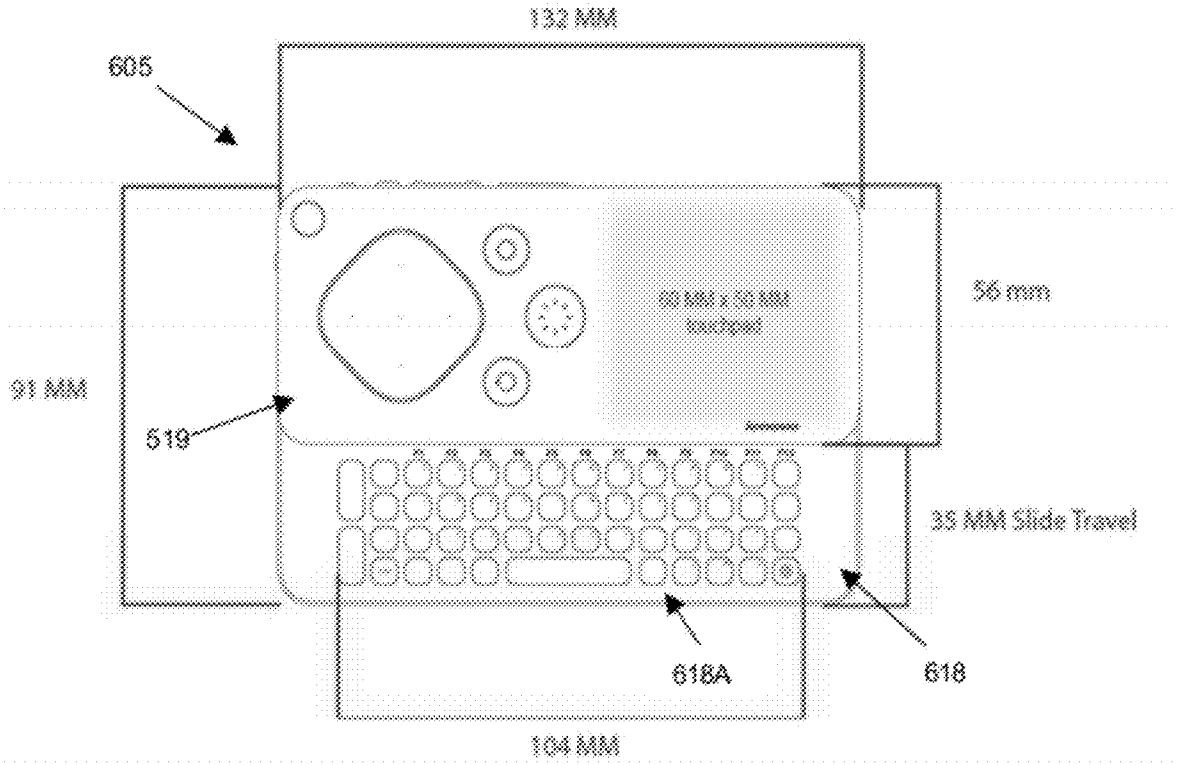
FIG. 6 illustrates a top view of an example convertible wireless remote control in landscape orientation.

Referring to FIG. 6, some example dimensions of a convertible wireless remote control 605 in the landscape orientation are illustrated. The top remote layer 619 is illustrated slid out from the lower QWERTY KB layer 618, exposing a QWERTY KB 618A. In the example embodiment shown, the QWERTY KB 618A has a lower (length) dimension of about 104 mm and a height of about 35 mm. In the landscape position, the overall height of the convertible wireless remote control is about 91 mm.

Referring to FIG. 7(A-B), perspective portrait and landscape views of an example convertible wireless remote control 705 are illustrated. In FIG. 7A, a portrait orientation is illustrated, where the top remote layer 719 is substantially atop the lower QWERTY KB layer 718. The top remote layer 719 includes a plurality of controls (e.g. mode 709, mute 710, volume (+/−) 711 and channel (+/−) 712) along a side edge, which can for example be default set to stay in IR mode, even when the convertible wireless remote control 705 is placed in the landscape orientation, and an IR learn activation key (program key) 707 along a front edge.

Referring to FIG. 7(C-D), front and rear views of an example convertible wireless remote control 705 (in portrait orientation) are illustrated. In a front view, as illustrated in FIG. 7C, top remote layer 719 covers bottom QWERTY KB layer 718 in a portrait orientation. Bottom QWERTY KB layer 718 includes angular edges (720A-B) to impart a substantially trapezoidal shape to bottom QWERTY KB layer 718. The angular edges, for example angular edges 720A and 720C impart a substantially flat surface (in this case, to the back of the bottom QWERTY KB layer 718) for easier gripping in the landscape orientation. This flat surface is substantially more comfortable to a user than a rounded surface, and gives the user a flat surface to rest the index fingers on the bottom QWERTY KB layer 718 during use in the landscape orientation (e.g. while typing with thumbs).

Similarly in FIG. 7D, in a rear view, bottom QWERTY KB layer 718 includes angular edges (720C-D) imparting a substantially trapezoidal shape to bottom QWERTY KB layer 718. Overall, the generally flat remote layer 719 and generally trapezoid shaped QWERTY KB layer 718 impart an inverted pyramid or "aircraft carrier" shape to the convertible wireless remote control 705. This provides adequate volume in bottom QWERTY KB layer 718 for accommodating large batters (AA batteries) while also providing a flat surface for more comfortable gripping in landscape orientation.

Figure 8:
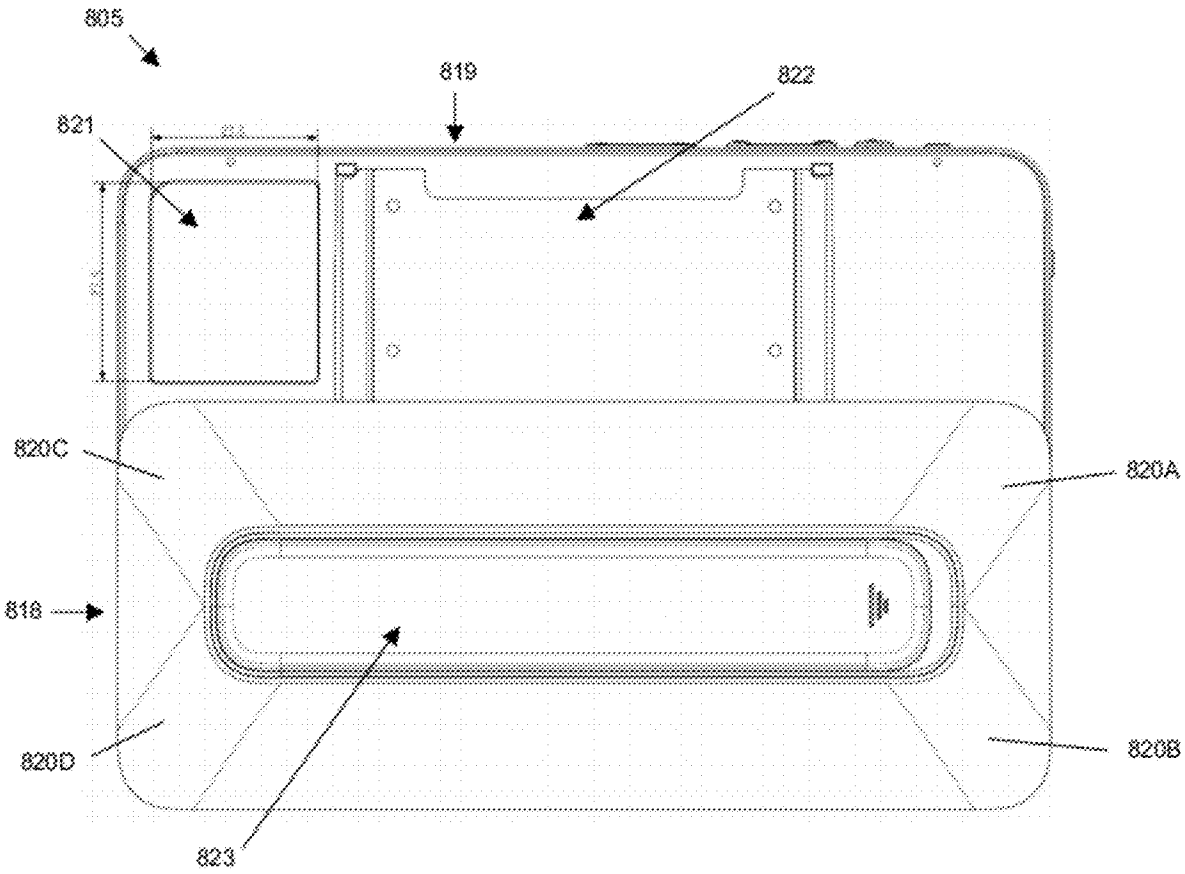
FIG. 8 illustrates a bottom view of an example convertible wireless remote control in a landscape orientation.

Referring to FIG. 8, a bottom view of an example convertible wireless remote control 805 is illustrated. Here, bottom of lower QWERTY KB layer 818 is shown. The top remote layer 819 is illustrated slid out from lower QWERTY KB layer 818 via a slider mechanism 822 in a landscape orientation, and a lower portion of a touchpad module 821 can be seen. The angular edges (820A-D) of bottom QWERTY KB layer 818 are illustrated and terminate at a bottom portion having a cover 823 thereon. Bottom QWERTY KB layer 818 includes the cover 824, the cover being releasable (for example via a clipping or sliding mechanism). The cover 824 can be rubber coated and encloses a battery compartment that houses one or more batteries, for example two AA batteries.

It should be understood that while specific example functions and dimensions have been described herein, these are non-limiting examples. Moreover, it should be understood that the functions of one or more input interfaces (buttons, touchpad, QWERTY KB, etc.) transition depending upon the mode. For example, in portrait orientation, a set of controls can be enabled (for example channel rocker) such that non-PC mode is maximized. Similarly, a set of controls can be disabled in portrait orientation (e.g. touchpad), as PC control is not paramount. Likewise, in landscape orientation, certain controls (e.g. QWERTY KB) can be enabled, whereas others (e.g. channel rocker) can be disabled or have their functionality switched (e.g. the channel rocker can be used as a mode switch in landscape orientation, as described). Further still, certain input devices may communicate via different means in different orientations. For example, IR controls in portrait orientation may switch to RF controls in landscape orientation or vice versa.

It should be understood that many of the functional characteristics of the embodiments described in this specification may be implemented as modules. Modules may include hardware circuits such as one or more processors with memory, programmable logic, and/or discrete components. The hardware circuits may perform hardwired logic functions, execute computer readable programs stored on non-signal storage devices, and/or execute programmed functions. The computer readable programs may in combination with other elements perform the functions of the embodiments.

It will be readily understood by those having ordinary skill in the art that embodiments may take the form of an entirely hardware embodiment or an embodiment containing both hardware and software elements. An embodiment that is implemented in software may include, but is not limited to, firmware, resident software, microcode, etc.

The computer readable programs may be any non-signal medium. Examples of a non-signal medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

Accordingly, elements may be implemented on at least one electronic device running suitable software programs. These may also be implemented on at least one Integrated Circuit or part of at least one Integrated Circuit. Thus, it is to be understood that the embodiments may be implemented in a combination of both hardware software. Again, computer/machine-readable programs may in combination with an electronic device perform the functions of the embodiments.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

In the drawings and specification there has been set forth example embodiments and, although specific terms are used, the description thus given uses terminology in a generic and descriptive sense only and not for purposes of limitation.

What is claimed is:

1. A convertible wireless remote control including:

an upper portion that has a rectangular side profile with a substantially flat upper and lower surface;

the upper surface including a touchpad that is inactive when the convertible wireless remote control is in a closed orientation and that is activated responsive to the convertible wireless remote control being slid open; and a lower portion slidably connected to the upper portion, wherein the lower portion comprises a QWERTY keyboard;

the lower portion having a substantially flat upper surface and substantially angular edges extending therefrom terminating in a substantially flat bottom surface;

the lower portion having a substantially trapezoidal shape and including a thickness about three times greater than the upper portion.

2. The convertible wireless remote control according to claim 1, wherein the lower portion has a volume accommodating two AA batteries.

3. The convertible wireless remote control according to claim 1, wherein the upper portion and lower portion are configured to slidably transition between a portrait orientation corresponding to a non-PC control mode in which one or more controls operate in an infrared mode and a landscape orientation corresponding to a PC control mode in which the one or more controls switch to operate in a radio frequency mode.

4. The convertible wireless remote control according to claim 3, wherein:

in the portrait orientation, the QWERTY keyboard area of the lower portion is covered; and in the landscape orientation, the upper portion activates the touchpad and the QWERTY keyboard area of the lower portion is exposed.

5. The convertible wireless remote control according to claim 3, wherein:

in the landscape orientation, the convertible wireless remote control switches to the PC control mode wherein one or more controls disposed on an upper surface of the upper portion are disabled.

6. The convertible wireless remote control according to claim 4, wherein the upper portion further comprises a mode button for switching between the non-PC control mode and the PC control mode.

7. A convertible wireless remote control including:

an upper portion that has a rectangular side profile with a substantially flat upper and lower surface;

the upper surface including a touchpad that is inactive when the convertible wireless remote control is in a closed orientation and that is activated responsive to the convertible wireless remote control being slid open;

wherein the touchpad is activated in the closed orientation responsive to pressing a predetermined button having at least one other function; and a lower portion slidably connected to the upper portion, wherein the lower portion comprises a QWERTY keyboard;

wherein the upper portion and the lower portion slide to transition between a PC control mode and a non-PC control mode;

the lower portion having a substantially flat upper surface and substantially angular edges extending therefrom terminating in a substantially flat bottom surface;

the lower portion having a substantially trapezoidal shape and including a thickness about three times greater than the upper portion.

8. The convertible wireless remote control according to claim 7, wherein the non-PC control mode corresponds to a mode controlling one or more devices via infrared.

9. The convertible wireless remote control according to claim 8, wherein the one or more devices are selected from a television and a multimedia disc player.

10. The convertible wireless remote control according to claim 7, wherein the PC control mode corresponds to a mode controlling a multimedia management system computer via radio frequency.

11. The convertible wireless remote control according to claim 7, wherein the upper portion comprises one or more of a power button, a mode button, a channel rocker, a volume rocker, a mute button, a five way navigation panel, a settings button, and a widget button.

12. The convertible wireless remote control according to claim 11, wherein one or more of the channel rocker, the volume rocker, and the mute button are disabled in the PC control mode.

13. The convertible wireless remote control according to claim 11, wherein the touchpad is enabled in PC control mode.

* * * * *